US005485990A

United States Patent [19]

Kato

[11] Patent Number: 5,485,990

[45] Date of Patent: Jan. 23, 1996

[54] IMAGE FORMING APPARATUS

[75] Inventor: Takeshi Kato, Toyokawa, Japan

[73] Assignee: Minolta Co., Ltd., Osaka, Japan

[21] Appl. No.: 337,822

[22] Filed: Nov. 8, 1994

[30] Foreign Application Priority Data

Nov. 12, 1993 [JP] Japan ..... 5-283766

[51] Int. Cl.[6] ..... B41F 13/58; G03G 15/00

[52] U.S. Cl. ..... 271/9.08; 271/9.09; 271/9.11; 355/200; 355/308; 355/321

[58] Field of Search ..... 355/308, 309, 355/311, 321, 210, 200; 271/9.08, 9.09, 9.11, 9.13, 162

[56] References Cited

U.S. PATENT DOCUMENTS

| | | | |
|---|---|---|---|
| 4,478,506 | 10/1984 | Miyoshi et al. | 355/271 |
| 4,569,582 | 2/1986 | Hyltoft | 355/202 |
| 4,605,215 | 8/1986 | Hyltoft | 271/9.05 |
| 4,733,310 | 3/1988 | Kapp et al. | 355/311 X |
| 4,958,822 | 9/1990 | Rutihauser et al. . | |
| 4,966,356 | 10/1990 | Ohyabu et al. . | |
| 5,191,382 | 3/1993 | Okamura et al. | 355/309 |

FOREIGN PATENT DOCUMENTS

| | | |
|---|---|---|
| 60-6538 | 1/1985 | Japan . |
| 60-230164 | 11/1985 | Japan . |
| 3-115026 | 5/1991 | Japan . |

*Primary Examiner*—Matthew S. Smith
*Attorney, Agent, or Firm*—Burns, Doane, Swecker & Mathis

[57] ABSTRACT

An image forming apparatus is disclosed which comprises a main body provided with image forming system, a standard feeding unit separably attached to the main body and adapted to store recording papers, and an optional feeding unit selectively attached between the main body and the standard feeding unit and adapted to store recording papers. The standard feeding unit includes a gear system which transmits drive force generated by a motor in the main body only to a feeding system of the standard feeding unit, and the optional feeding unit includes a gear system which transmits the drive force generated by the motor both to the feeding system of the optional feeding unit and to the gear system of the standard feeding unit. While the image forming apparatus is in the mode having the optional feeding unit attached thereto, an electric signal and drive force are transmitted through the optional feeding unit between the main body and the standard feeding unit.

20 Claims, 3 Drawing Sheets

IMAGE FORMING APPARATUS

BACKGROUND OF THE INVENTION

1. Field of the Invention

This invention relates to an image forming apparatus such as a copying device or a printer which is provided normally with a standard feeding unit and optionally with an optional feeding unit.

2. Description of the Prior Art

The image forming apparatus such as the copying device or the printer is provided with a paper feeding unit which holds recording papers. These recording papers are carried one at a time from the paper feeding unit to the image forming system, in which a toner image is transferred onto the recording paper and fixed thereon. Image forming apparatuses of some types are adapted to be provided with a plurality of paper feeding units. An optional feeding unit is disposed below the standard feeding unit as connected thereto (refer to Japanese Laid-Open Patent Application 03-115,026).

The optional feeding unit is provided as with a paper feed roller adapted to discharge the recording papers stored in the unit one by one. The drive force for rotating this paper feed roller and discharging and forwarding the recording papers is transmitted from a motor which is disposed in the main body of the image forming apparatus. The standard feeding unit, therefore, is provided with a drive force transmission system which transmits the drive force mentioned above to the optional feeding unit disposed thereunder. This drive transmission system includes a gear system and the like.

Such electric signals as a signal indicating the detection of presence or absence of paper supply and a signal for starting paper feed which are to be used in the optional feeding unit are also transmitted from the main body of the image forming apparatus. The standard feeding unit, for the purpose of transmitting the electric signals mentioned above to the optional feeding unit disposed thereunder, is provided with an electrical connector which is capable of being connected to an electrical connector installed in the optional feeding unit. The electrical connector includes a freely detachable connector and the like.

In the image forming apparatus of the type having the optional feeding unit connected to the lower part of the standard feeding unit, a part of the gear system or the connector of the drive transmission system installed in the standard feeding unit is fated to be exposed under the standard feeding unit to the exterior.

When the part (gear or connector) connected to the optional feeding unit is exposed to the exterior, however, it calls for careful handling and possibly causes trouble. Logically, an idea of solving this problem by concealing the exposed part with a lid or a cover may be conceived. When the cover is actually adopted, a user is compelled to take the trouble of removing this cover whenever he attaches the optional feeding unit to the image forming apparatus. Further, the cover constitutes an addition to the component parts of the apparatus and entails an increase in cost of production of the apparatus.

SUMMARY OF THE INVENTION

This invention has been produced with a view to overcoming the problem entailed by the prior art as described above. It is an object of this invention to provide an image forming apparatus which is furnished normally with a standard feeding unit and optionally with an optional feeding unit and which is so adapted as to facilitate the handling of the standard feeding unit, eliminate the factor responsible for the trouble, and lower the cost of production.

To accomplish this object, the present invention provides an image forming apparatus comprising: a main body including an image forming system; a manual feeding tray included in said main body to feed recording medium manually; a motor included in said main body; a standard feeding unit disposed below said main body and including a feeding system to feed recording medium accommodated therein and a gear system at the upper part which transmits drive force generated by said motor only to said feeding system, said standard feeding unit being separably connected with said main body so as to optionally dispose an optional feeding unit between said main body and said standard feeding unit, wherein a direction of feeding recording medium from said manual feeding tray is the same as a direction of feeding recording medium from said standard feeding unit.

The image forming apparatus constructed as described above is in its standard construction when the standard feeding unit is attached to the main body. The optional attachment of the optional feeding unit to this standard construction is attained by separating the standard feeding unit from the main body and fitting the optional feeding unit between the main body and the standard feeding unit. In the above embodiment of its standard construction, the gear system transmits the drive force generated by the motor to the feeding system to feed the recording medium accommodated in the standard feeding unit. When the image forming apparatus assumes the standard construction which avoids the attachment of the optional feeding unit, therefore, the gear system of the standard feeding unit will not be exposed from the standard feeding unit to the exterior. Thus, the standard feeding unit which is normally installed will be handled easily and the factor responsible for the trouble will be precluded. Further, the image forming apparatus has no use for such an extra implement as a cover for the gear system and induces no increase in cost. In addition it is not necessary to stack the recording papers in consideration of the direction of transferring the recording papers in response to the manual or automatic feed. And this may reduce errors in the direction of stacking the recording papers.

Further, the aforementioned object is accomplished by an image forming apparatus comprising: a main body including an image forming system; a standard feeding unit accommodating recording medium and including a first feeding system which feeds the recording medium toward said main body, said standard feeding unit being separably connected with said main body by a first drive transmission system provided therein; and an optional feeding unit accommodating recording medium and including a second feeding system which feeds the recording medium accommodated in the optional feeding unit toward said main body, said optional feeding unit being optionally disposed between said main body and said standard feeding unit and connected with said main body and said standard feeding unit by a second drive transmission system provided therein, wherein said first drive transmission system transmits drive force generated in said main body only to the first feeding system, and said second drive transmission system transmits the drive force both to the second feeding system and to said first drive transmission system.

Owing to the construction which permits the optional feeding unit to be optionally attached between the main body and the standard feeding unit, the standard feeding unit is only required to be provided exclusively with the gear system which transmits the drive force generated by the motor of the main body thereto and the electric connector which transmits the electric signals generated by the main body thereto. The present construction, therefore, allows one among the electric connectors to be eliminated and hence, the gear system of the standard feeding unit to be simplified as compared with the construction of the type which causes the optional feeding unit to be added without requiring separation of the main body and the standard feeding unit thereof. This simplification brings about a proportional reduction in the cost of the standard feeding unit installed as a standard component and consequently in the total cost of the image forming apparatus.

DETAILED DESCRIPTION OF THE PREFERRED EMBODIMENT

Now, one embodiment of this invention will be described below with reference to the accompanying drawings.

Figure 1A:
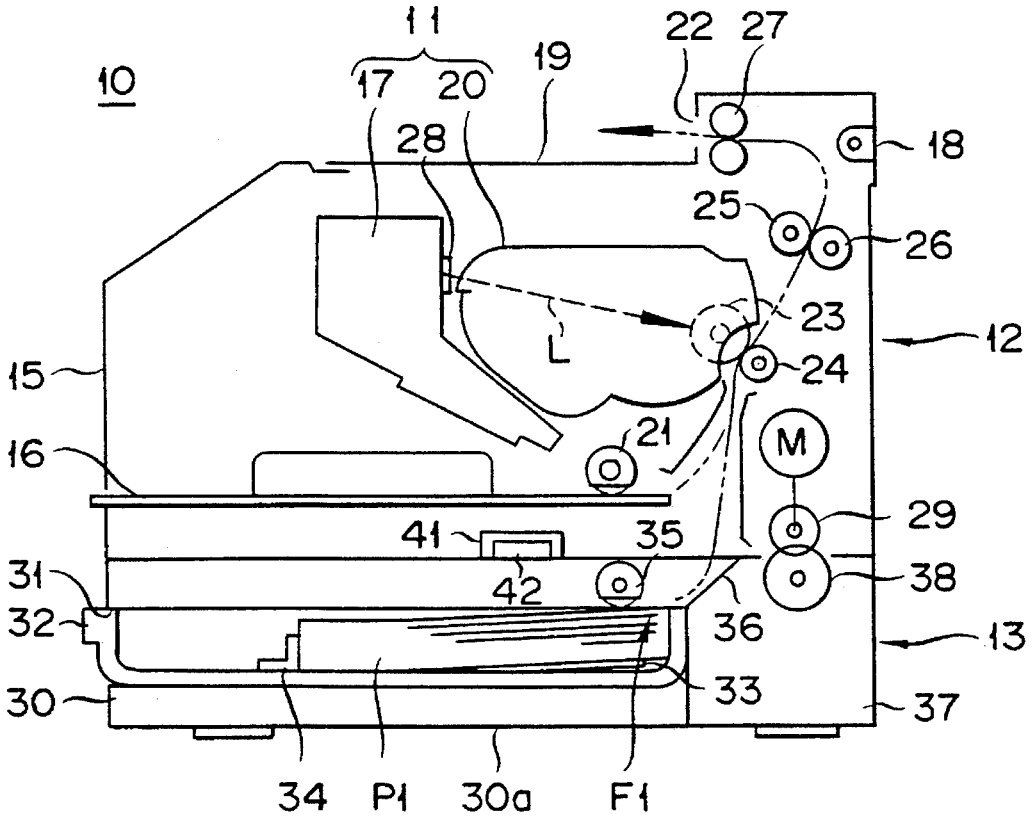
FIG. 1A is a schematic cross section showing the standard construction of a laser beam printer provided with a main body and a standard feeding unit.
Figure 1B:
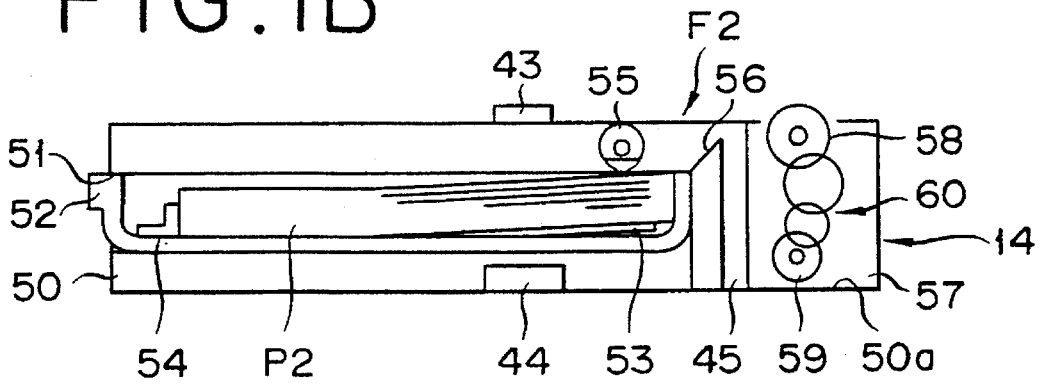
FIG. 1B is a schematic cross section showing an optional feeding unit which can be optionally attached to the laser beam printer.

First, the whole construction of a laser beam printer 10 of the present embodiment will be outlined. The laser beam printer 10, as shown in FIG. 1A, is provided with a main body 12 having image forming system 11 incorporated therein and a standard feeding unit 13 adapted to be freely attached separably to the lower side of the main body 12. The construction of this embodiment constitutes the standard construction of the present laser beam printer 10. In addition to this standard construction, an optional feeding unit 14 shown in FIG. 1B is prepared for optional use in the laser beam printer 10. The standard feeding unit 13 and the optional feeding unit 14 are so adapted as to accommodate recording medium or papers P1 and P2 different in size to be severally or to accommodate recording papers of an equal size in different orientations. The optional feeding unit 14 is attached as interposed between the main body 12 and the standard feeding unit 13 as shown in FIG. 2.

This laser beam printer 10 realizes a reduction in the cost of the paper feeding part by unitizing the standard paper feeding part which is incorporated in the main body 12 as a standard feeding unit 13 and maximizing the number of component parts to be used commonly between the standard feeding unit 13 and the optional feeding unit 14 which is intended for optional attachment.

Figure 2:
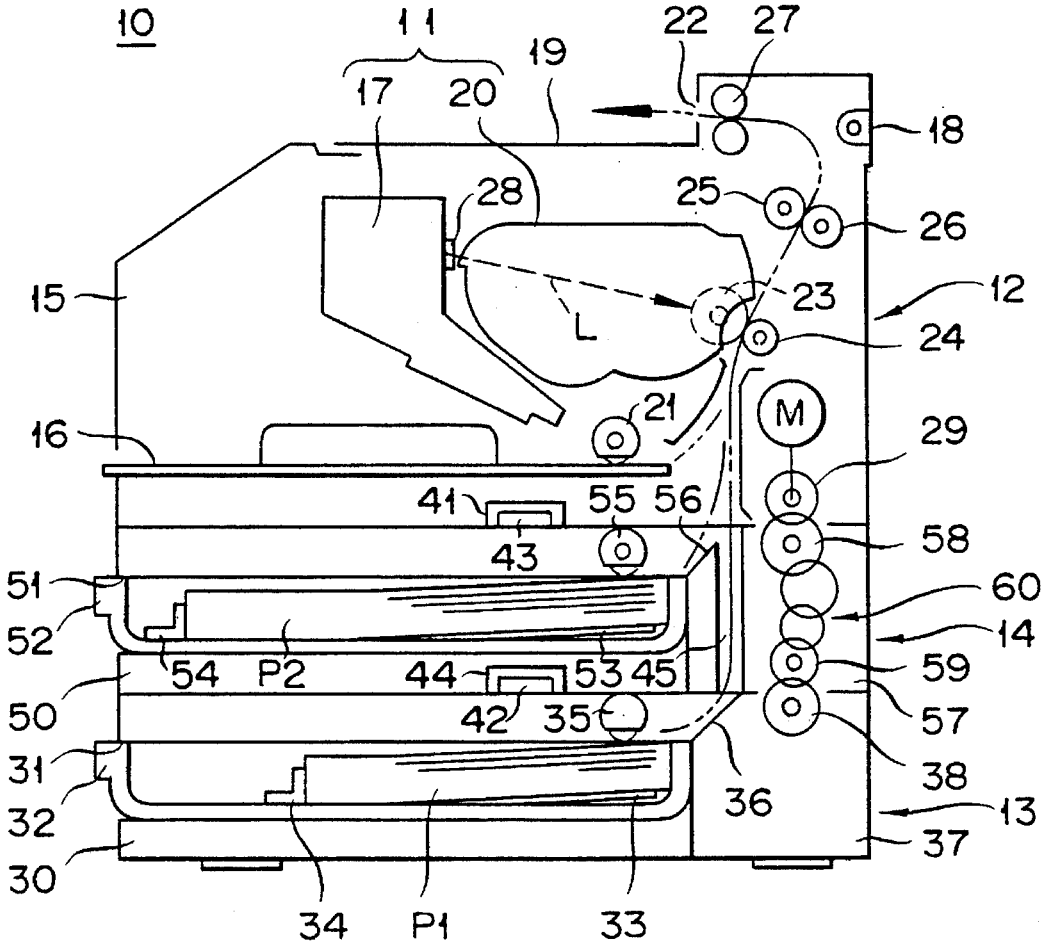
FIG. 2 is a schematic cross section showing the whole construction of the laser beam printer having the optional feeding unit attached thereto.

In the laser beam printer 10 shown in FIG. 1 and FIG. 2, the left side of a frame 15 of the main body 12 in the diagrams is the front side of the printer. On a manual feeding tray 16 which is built in the frame 15, recording papers for manual feeding are held in a stacked form. The main body 12 is provided in the central part thereof with a laser beam scanning optical unit 17. A lid member 19 is attached to the printer so as to be freely rotatable around a hinge part 18 which is provided in the rear end part of the frame 15. Further, inside the main body 12, an image forming cartridge 20 is detachably attached below the lid member 19.

The recording papers stacked on the manual feeding tray 16 are forwarded therefrom one by one by a paper feed roller 21, carried as guided by a guide member, and discharged onto the lid member 19 through a discharging slit 22 formed in the lid member 19 toward the direction of the front side of the laser beam printer. A photosensitive drum 23 is rotatably incorporated in the image forming cartridge 20 and a transfer roller 24 for transferring onto a recording paper a latent image formed on the photosensitive drum 23 is rotatably attached to the frame 15. A fixing roller 25 and a pressure roller 26 are attached to the frame 15 for the purpose of thermally fusing the transferred image on the recording paper. For the purpose of causing the recording paper having the image formed thereon to be discharged via the discharging slit 22 into the lid member 19, the lid member 19 has a paper discharge roller pair 27 attached to the inner side.

The optical unit 17, though omitted from illustration, is provided with a polygon mirror to be illuminated by a light beam from a light source and further provided with such well-known members as a reflecting mirror and a toroidal mirror. A laser beam L emitted from this optical unit 17 is passed through the glass set in a window part 28 and projected onto the image forming cartridge 20.

The image forming cartridge 20 is otherwise called an image cartridge or an image forming unit. The image forming cartridge 20 has the photosensitive drum 23 built inside a resinous case thereof. And the developer to be supplied to the photosensitive drum 23 is also contained in a hopper which is formed as partitioned inside the casing. The image forming cartridge 20 is replaced with a new supply when the developer ceases to exist in the hopper or when the supply of the developer in the hopper runs short. In the leading end face of the casing, an entrance slit for introducing the laser beam L from the optical unit 17 is formed. Inside the casing, a light path guide part is formed as extended from the entrance slit to the photosensitive drum 23. Through this light path guide part, the laser beam L from the optical unit 17 is projected onto the photosensitive drum 23.

The standard feeding unit 13 mentioned above is separable from the main body 12. The standard feeding unit 13 is provided with a boxlike casing 30 detachably attached to the lower side of the main body 12 and a paper feed cassette 32 detachably attached inside the casing 30 via an opening 31 formed on the front side of this casing 30. The casing 30 has a flat bottom plate 30*a* at the bottom thereof. When the main body 12 and the standard feeding unit 13 are joined to each other, they are positioned and fixed through matched concave and convex portions, as not shown, which are respectively formed on the frame 15 and the casing 30. The main body 12 and the standard feeding unit 13 may be fixed with screws and the like.

Inside the paper feed cassette 32 is provided a flat bottom plate 33 which is kept urged with a spring upwardly in the diagram. The recording papers P1 are held in a stacked form on this flat bottom plate 33. The edges of the recording papers P1 on the rear end side relative to the direction of conveyance thereof are aligned by an adjusting plate 34. The recording papers P1 held inside the paper feed cassette 32 are forwarded one by one by a paper feed roller 35 rotatably supported by the casing 30 and conveyed toward the photosensitive drum 23 as guided by a guide member 36. The standard feeding unit 13 may be provided with a conveying guide roller.

The drive force for rotating the paper feed roller 35 and feeding or conveying the recording papers P1 is transmitted from the main body 12. A space 37 for accommodating a drive transmission system required therefor is formed on the rear side from the guide member 36. The drive transmission system is provided with a second coupling gear 38 (corresponding to the second drive transmission system) rotatably supported on an upper part of the casing 30. This second coupling gear 38 is adapted so as to, when the main body 12 is coupled with the standard feeding unit 13, be interlocked with a first coupling gear 29 (corresponding to the first drive transmission system) driven by a motor M and provided in the main body 12.

For the purpose of transmitting an electric signal for use in the standard feeding unit 13, the main body 12 is provided in the lower part thereof with a female-type first electrical connector 41 and the standard feeding unit 13 is provided in the upper part thereof with a male-type second electrical connector 42. These two connectors 41 and 42 are electrically connected when the main body 12 and the standard feeding unit 13 are coupled with each other. Through these first and second connectors 41 and 42, a signal indicating the detection of presence or absence of paper, a signal for starting the feed of paper, etc. are transmitted between the main body 12 and the standard feeding unit 13. On the other hand, when the second connector provided in the upper part of the standard feeding unit 13 is changed into female-type, dust or the like is easy to heap up on a concave portion of the female-type second connector and consequently possibility of the accumulated dust interfering with the operation of the electric connection comes into existence. However, the male-type second connector according to the embodiment of the invention may avoid such a problem.

As shown in FIG. 2, the optional feeding unit 14 is adapted to be optionally attached to the printer 10 in the standard construction as shown in FIG. 1A. The addition of this optional feeding unit 14 to the laser beam printer 10 is implemented by provisionally separating the main body 12 and the standard feeding unit 13 and setting the optional feeding unit 14 in place as interposed therebetween.

The optional feeding unit 14 is provided, as shown in FIG. 1B, with a boxlike casing 50 detachably attached between the main body 12 and the standard feeding unit 13 and a paper feed cassette 52 detachably attached in the casing 50 via an opening 51 formed on the front side of the casing 50. The fixing structure for the main body 12 and the optional feeding unit 14 is similar to that for the main body 12 and the standard feeding unit 13. When the addition of the optional feeding unit 14 is effected, the main body 12 and the optional feeding unit 14 are positioned and fixed through unillustrated matched concave and convex portions formed respectively on the frame 15 and the casing 50. The lower part of the optional feeding unit 14 is similar in construction to that of the main body 12. Owing to this construction, the standard feeding unit 13 is coupled with the lower part of the optional feeding unit 14 similarly to the coupling thereof with the main body 12. It is optional with the user to attain fixation between the main body 12 and the optional feeding unit 14 and between the optional feeding unit 14 and the standard feeding unit 13 by the use of screws, for example.

The paper feed cassette 52, similarly to the paper feed cassette 32 for the standard feeding unit 13, holds recording papers P2 in a stacked form on a flat bottom plate 53, and edges of the recording papers P2 on the rear end side relative to the direction of conveyance thereof are aligned by an adjusting plate 54. The recording papers P2 held in the paper feed cassette 52 are forwarded one by one by a paper feed roller 55 rotatably supported on the casing 50 and conveyed toward the photosensitive drum 23 as guided by a guide member 56. In this optional feeding unit 14, a paper transport path 45 for guiding and passing the recording paper P1 is formed. The recording papers P1 contained in the standard feeding unit 13 now positioned on the bottom side are conveyed through the paper transport path 45 to the main body 12. The optional feeding unit 14 may be furnished with a conveying guide roller.

The drive force for rotating the paper feed roller 55 and feeding or conveying the recording papers P2 is transmitted from the main body 12. A space 57 for accommodating a drive transmission system required therefor is formed on the rear side from the paper transport path 45. The drive transmission system is provided with a third coupling gear 58 (corresponding to the third drive transmission system) rotatably supported on the casing 50. This third coupling gear 58 is adapted to be interlocked with the first coupling gear 29 of the main body 12 when the main body 12 and the optional feeding unit 14 are interconnected. Further, in the lower part of the casing 50, a fourth coupling gear 59 (corresponding to the fourth drive transmission system) is rotatably supported. This fourth coupling gear 59 is so adapted as to be interlocked with the second coupling gear 38 of the standard feeding unit 13 when the standard feeding unit 13 is connected to the lower side of the optional feeding unit 14. The third and fourth coupling gears 58 and 59 of the optional feeding unit 14 are interconnected through a belt or such a gear system 60 as shown in the diagram. The casing 50 of the optional feeding unit 14 has an opening **50*a* at the bottom thereof so as to expose the coupling gear 59, the gear system 60**, etc.

The third coupling gear 58 of the optional feeding unit 14 corresponds to the second coupling gear 38 of the standard feeding unit 13 and the fourth coupling gear 59 corresponds to the first coupling gear 29 of the main body 12.

Further, for the purpose of transmitting an electric signal for use in the optional feeding unit 14, the optional feeding unit 14 is provided thereon with a male-type third electrical connector 43 adapted to fit in the first connector 41 of the main body 12. The two connectors 41 and 43 are electrically connected to each other when the main body 12 and the optional feeding unit 14 are interconnected. Through the first and third connectors 41 and 43, a signal indicating the detection of presence or absence of a paper is transmitted between the main body 12 and the optional feeding unit 14. Further, the optional feeding unit 14 is provided in the lower part thereof with a female-type fourth electrical connector 44 adapted to fit in the second connector 42 of the standard feeding unit 13. The third connector 43 and the fourth connector 44 in the optional feeding unit 14 are electrically interconnected through an unillustrated harness or substrate. When the standard feeding unit 13 is connected to the lower side of the optional feeding unit 14, the second and fourth connectors 42 and 44 are electrically interconnected and a prescribed electric signal for use in the standard feeding unit 13 is transmitted through the optional feeding unit 14 between the main body 12 and the standard feeding unit 13.

The third connector 43 of the optional feeding unit 14 corresponds to the second connector 42 of the standard feeding unit 13 and the fourth connector 44 corresponds to the first connector 41 of the main body 12.

Now, the method for transmitting the signal and drive force generated in the main body 12 to the standard feeding unit 13 now positioned on the lowermost part when the optional feeding unit 14 is attached to the laser beam printer 10 will be explained below.

The drive force from the main body 12 is transmitted via the first coupling gear 29, the third coupling gear 58 of the optional feeding unit 14, and the gear system 60 to the fourth coupling gear 59 and the second coupling gear 38 of the standard feeding unit 13 and used to drive the paper feed rollers 35 and 55 respectively of the paper feeding units 13 and 14.

The electric signal generated in the main body 12 can be transmitted from the first connector 41 of the main body 12 to the third connector 43 of the optional feeding unit 14, transmitted thence to the fourth connector 44 of the optional feeding unit 14 via a harness or the like, and transmitted further from the fourth connector 44 to the second connector 42 of the standard feeding unit 13 and to the standard feeding unit 13 itself. The electric signal from the standard feeding unit 13 to the main body 12 is transmitted in the direction opposite to the direction mentioned above.

Figure 3:
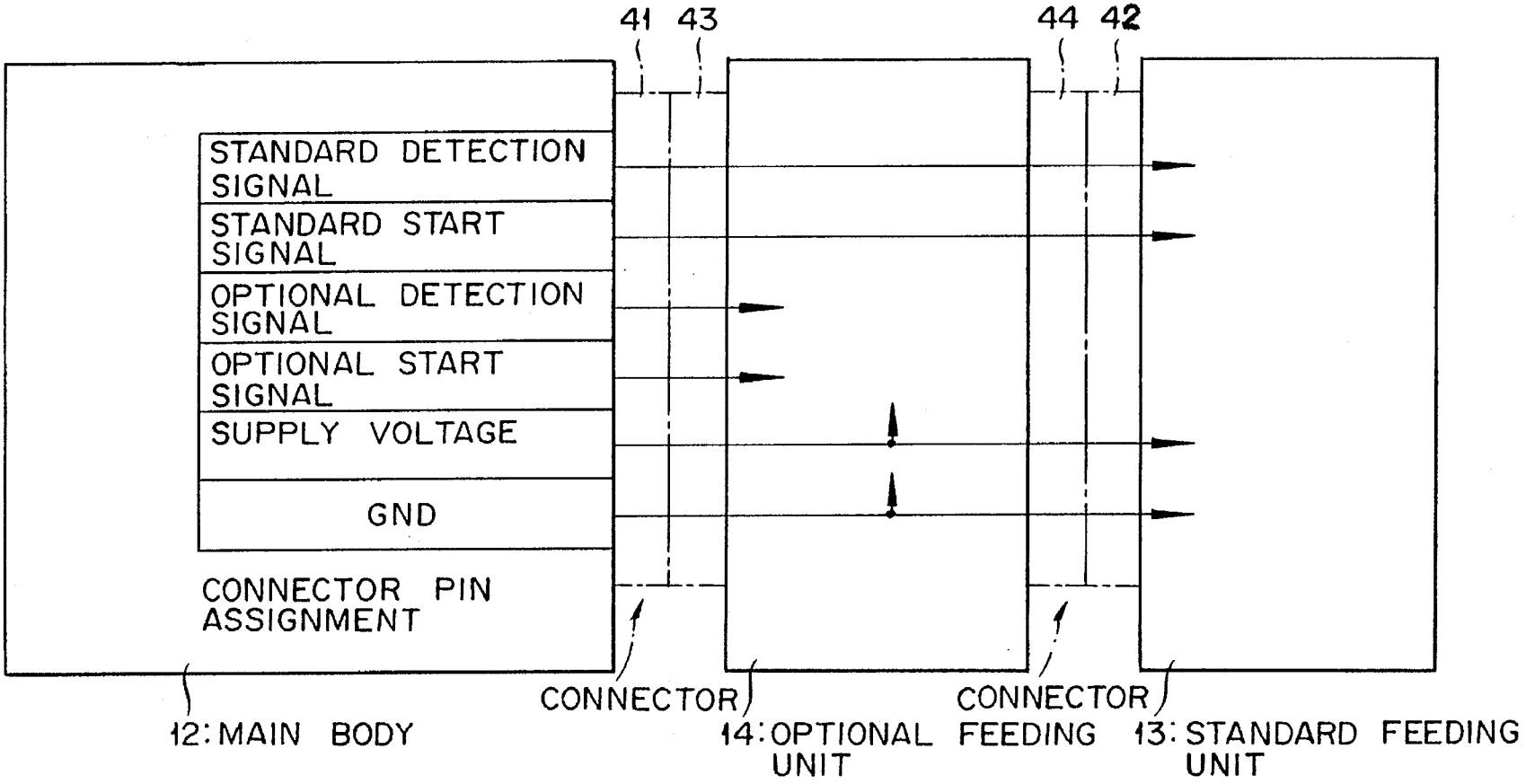
FIG. 3 is a diagram showing one example of connector pin assignment.

The main body 12, no matter whether the paper feeding unit attached directly to the lower side thereof may be the standard feeding unit 13 or the optional feeding unit 14, must discriminate between the standard and the optional unit and carry out a pertinent control. It suffices for the sake of this discrimination to dispose a pin for use with the standard feeding unit 13 and a pin for use with the optional feeding unit 14 distinguishably from each other and transmit the electric signal in the separate path. One example of the connector pin assignment is shown in FIG. 3.

As described above, the present embodiment implements the optional selective attachment of the optional feeding unit 14 to the laser beam printer 10 by separating the standard feeding unit 13 from the main body 12 and attaching the optional feeding unit 14 between the main body 12 and the standard feeding unit 13. When the laser beam printer 10 assumes the standard construction, therefore, the parts (such as connectors and gears) for connection with the optional feeding unit 14 are not exposed from the lower part of the standard feeding unit 13 to the exterior, with the result that the standard feeding unit 13 which is prevalently put to use can be handled easily and the very factor responsible for trouble can be eliminated. Thus, the laser bean printer 10 has no use for a cover which would be otherwise required in concealing the exposed part and, therefore, entails no increase in cost.

Further, since the optional feeding unit 14 is adapted to be selectively attached between the main body 12 and the standard feeding unit 13, the standard feeding unit 13 is only required to be provided with just one connector, viz. the second connector 42 which is connected to either the first connector 41 of the main body 12 or the fourth connector 44 of the optional feeding unit 14. The standard feeding unit 13 is only required to be provided with just one coupling gear, viz. the second coupling gear 38 which is connected to either the first coupling gear 29 of the main body 12 or the fourth coupling gear 59 of the optional feeding unit 14. In short, the standard feeding unit 13 is required to be provided only with the drive transmission system for driving the paper feed roller 35 disposed thereon and the second connector 42 required therefor and is not required to be provided with such gears and electric connectors as are used for forwarding the power to the optional feeding unit disposed on the lower side. As compared with the laser beam printer of the conventional type which causes the optional feeding unit to be added to the lower side of the standard feeding unit without separating the main body and the standard feeding unit, the laser beam printer of the present embodiment can save one of the connectors which has been provided for the standard feeding unit 13 and can simplify the drive transmission system provided for the standard feeding unit 13. As a result, the cost of the standard feeding unit 13 can be proportionally lowered and consequently the cost of the laser beam printer 10 as a whole can be decreased.

Incidentally, in consequence of the simplification of the standard feeding unit 13, the optional feeding unit 14 is required to be provided with the gears 59 and 60 and the connector 44 which serve the purpose of transmitting the drive force to the standard feeding unit 13 disposed on the lower side. As viewed separately, therefore, the optional feeding unit 14 entails a slight increase in cost. In consideration of the fact that generally the ratio of attachment of an optional item to a commercial product is not very high, however, the laser beam printer of the construction of the present embodiment which permits the optional feeding unit 14 to be attached between the main body 12 and the standard feeding unit 13 proves to be less expensive in terms of total calculation.

And yet in the embodiment of the invention the direction of feeding the recording papers stacked on the manual feeding tray 16 provided in the main body 12 is equivalent to the direction of feeding the recording papers on the standard feeding unit 13 and the optional feeding unit 14 mounted on the lower part of the main body 12. Consequently it is not necessary to stack the recording papers in consideration of the direction of transferring the recording papers in response to the manual or automatic feed and errors in the direction of stacking the recording papers may be reduced on grounds that the direction of transferring the recording papers from manual feeding component is not different from the direction of transferring the recording papers from automatic feed component in the embodiment.

The optional feeding unit 14 to be inserted between the main body 12 and the standard feeding unit 13 does not need to be limited to the example shown in the diagrams. It is optional with the manufacturer to contemplate a plurality of optional feeding units 14 for the insertion. When these optional feeding units 14 are inserted in a superposed state, however, the possibility may arise that the main body 12 will incur difficulty in transmitting the driving force with gears to all these optional feeding units 14 on account of the torque of the motor M which is provided for the main body 12. To overcome this drawback, the optional feeding units 14 may severally incorporate motors therein and the drive systems for the paper feed rollers may be independently assigned to the units 14 and adapted exclusively to effect electrical coupling. Conversely, if the motor of the main body 12 happens to have ample torque, it is naturally desirable for the sake of saving cost to avoid providing the optional feeding units 14 with a motor. And when these optional feeding units 14 are inserted in the superposed state, the feeding unit may be identified by means of disposing the individual pin for use with the respective feeding unit and transmitting the electric signals generated in the main body 12 by separate paths. Optionally the feeding unit may be discriminated by means of transmitting the electric signal in the same path and detecting the discrimination signal allocated to the several feeding unit.

What is claimed is:

1. An image forming apparatus comprising:

a main body including an image forming system;

a manual feeding tray included in said main body to feed a recording medium manually;

a motor included in said main body;

a standard feeding unit disposed below said main body and including a feeding system to feed a recording medium accommodated therein and a gear system on an upper part of said standard feeding unit which transmits drive force generated by said motor only to said feeding system, said standard feeding unit being separably connected with said main body so as to optionally dispose an optional feeding unit between said main body and said standard feeding unit, wherein a direction of feeding a recording medium from said manual feeding tray is the same as a direction of feeding a recording medium from said standard feeding unit.

2. The image forming apparatus as claimed in claim 1, wherein said optional feeding unit has a gear system which transmits drive force generated by said motor both to a feeding system of said optional feeding unit and to the gear system of said standard feeding unit.

3. The image forming apparatus as claimed in claim 1, wherein said standard feeding unit includes an electrical connector which transmits electric signals generated in said main body only to said standard feeding unit.

4. An image forming apparatus comprising:

a main body including an image forming system, a motor and a manual feeding tray to feed a recording medium manually;

a standard feeding unit which has a feeding system to feed a recording medium accommodated therein toward the main body and separably connected with said main body by a gear system which transmits drive force generated by the motor only to the feeding system of said standard feeding unit; and an optional feeding unit which has a feeding system to feed a recording medium accommodated therein and is optionally disposed between said main body and said standard feeding unit, the optional feeding unit has a gear system which transmits the drive force generated by the motor both to the feeding system of said optional feeding unit and to the gear system of said standard feeding unit, wherein a direction of feeding of the recording medium from said manual feeding tray is the same as a direction of feeding the recording medium from said standard and optional feeding units.

5. The image forming apparatus as claimed in claim 4, wherein said standard feeding unit has a convex shaped electric connector on its upper part which transmits electric signals generated in said main body to said standard feeding unit.

6. The image forming apparatus as claimed in claim 4, wherein said optional feeding unit has an electric connector which transmits electric signals generated in said main body both to said optional feeding unit and to said standard feeding unit.

7. An image forming apparatus comprising:

a main body including an image forming system;

a standard feeding unit accommodating recording media and including a feeding system which feeds the recording media toward said main body, said standard feeding unit being separably connected with said main body so as to optionally dispose an optional feeding unit between said main body and said standard feeding unit; and a gear system which is provided in said standard feeding unit and transmits drive force generated in said main body only to the feeding system of said standard feeding unit.

8. The image forming apparatus as claimed in claim 7 wherein said main body includes a motor which generates drive force.

9. The image forming apparatus as claimed in claim 7, wherein said standard feeding unit includes an electrical connector which transmits electric signals generated in said main body only to said standard feeding unit.

10. The image forming apparatus as claimed in claim 9, wherein said electrical connector is provided on an upper part of said standard feeding unit, and has a convex shape.

11. An image forming apparatus comprising:

a main body including an image forming system;

a standard feeding unit accommodating recording media and including a first feeding system which feeds the recording media toward said main body, said standard feeding unit being separably connected with said main body by a first drive transmission system provided therein; and an optional feeding unit accommodating recording medium and including a second feeding system which feeds the recording media accommodated in the optional feeding unit toward said main body, said optional feeding unit being optionally disposed between said main body and said standard feeding unit and connected with said main body and said standard feeding unit by a second drive transmission system provided therein, wherein said first drive transmission system transmits drive force generated in said main body only to the first feeding system, and said second drive transmission system transmits the drive force both to the second feeding system and to said first drive transmission system.

12. The image forming apparatus as claimed in claim 11, wherein said main body includes a motor which generates drive force.

13. The image forming apparatus as claimed in claim 11, wherein said standard feeding unit has a flat bottom plate at the bottom thereof, and said optional feeding unit has an opening at the bottom thereof so as to expose a part of said second drive transmission system.

14. The image forming apparatus as claimed in claim 11, wherein said optional feeding unit includes a paper transport path which vertically goes through the optional feeding unit so as to transport a recording media fed from said standard feeding unit to said main body therethrough.

15. The image forming apparatus as claimed in claim 11, wherein said standard feeding unit includes an electrical connector which transmits electric signals generated in said main body only to said standard feeding unit.

16. The image forming apparatus as claimed in claim 11, wherein said optional feeding unit has an electric connector which transmits electric signals generated in said main body both to said optional feeding unit and to said standard feeding unit.

17. An image forming apparatus comprising:

a main body including an image forming system;

a standard feeding unit accommodating recording media and including a feeding system which feeds the recording media toward said main body, said standard feeding unit being separably connected with said main body so as to optionally dispose an optional feeding unit between said main body and said standard feeding unit; and an electrical connector included in said standard feeding unit and transmits electric signals generated in said main body only to said standard feeding unit.

18. The image forming apparatus as claimed in claim 17, wherein said electrical connector is disposed on an upper part of said standard feeding unit and has an convex shape.

19. The image forming apparatus as claimed in claim 17, wherein said standard feeding unit includes a gear system which transmits drive force generated in said main body only to said standard feeding unit.

20. An image forming apparatus comprising:

a main body including an image forming system;

a standard feeding unit accommodating recording media; and being disposed below said main body; and a drive transmission system which is included in said standard feeding unit to transmit drive force generated in said main body thereto and connects said standard feeding unit only upward, wherein said standard feeding unit is separably connected with said main body by said drive transmission system so as to optionally dispose an optional feeding unit between said main body and said standard feeding unit.

* * * * *